US011320763B1

(12) United States Patent
Takeda

(10) Patent No.: US 11,320,763 B1
(45) Date of Patent: May 3, 2022

(54) DEVELOPER LAYER REGULATING MEMBER THAT CONTROLS A THICKNESS OF A DEVELOPER LAYER

(71) Applicant: TOSHIBA TEC KABUSHIKI KAISHA, Tokyo (JP)

(72) Inventor: Kazuhisa Takeda, Tagata Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/195,872

(22) Filed: Mar. 9, 2021

(51) Int. Cl.
*G03G 15/08* (2006.01)
*G03G 15/09* (2006.01)

(52) U.S. Cl.
CPC ..... *G03G 15/0812* (2013.01); *G03G 15/0818* (2013.01); *G03G 15/0942* (2013.01)

(58) Field of Classification Search
CPC ..... G03G 15/0812
USPC ..... 399/274, 284
See application file for complete search history.

(56) References Cited

U.S. PATENT DOCUMENTS 6,175,708 B1 * 1/2001 Ohashi et al. ..... G03G 15/0812 399/274
8,104,176 B2 * 1/2012 Takahashi et al. ..... G03G 15/0812 399/275
9,152,077 B2 * 10/2015 Yokoi et al. ..... G03G 15/0812
9,377,711 B2 * 6/2016 Yokoi et al. ..... G03G 15/0812
2013/0170876 A1 * 7/2013 Brown et al. ..... G03G 15/0812 399/284
2014/0321887 A1 * 10/2014 Matsumoto et al. ..... G03G 15/0812 399/284
2021/0200118 A1 * 7/2021 Kawakami et al. ..... G03G 15/0812

FOREIGN PATENT DOCUMENTS

| | | |
|---|---|---|
| JP | 10-48933 | 2/1998 |
| JP | 2005-121763 | 5/2005 |
| JP | 2010-048838 | 3/2010 |
| JP | 2010-271358 | 12/2010 |

* cited by examiner

*Primary Examiner* — William J Royer
(74) *Attorney, Agent, or Firm* — Amin, Turocy & Watson LLP

(57) ABSTRACT

According to one embodiment, there is provided a developer layer regulating member including: a magnetic material extending in an axis direction of a developing roller; a non-magnetic material facing the magnetic material; and first and second spot weld rows that bond the magnetic material to the non-magnetic material. The magnetic material includes a first end located near the developing roller and a second end located on an opposite side of the first end. The first spot weld row extends in the axis direction of the developing roller between the first and second ends of the magnetic material. The second spot weld row extends in the axis direction of the developing roller between the first spot weld row and the second end of the magnetic material.

20 Claims, 4 Drawing Sheets

DEVELOPER LAYER REGULATING MEMBER THAT CONTROLS A THICKNESS OF A DEVELOPER LAYER

FIELD

Embodiments described herein relate generally to developer layer regulating members.

BACKGROUND

Image forming apparatuses such as multifunction peripherals (MFPs) and printers are known. The image forming apparatus includes a photoreceptor on which a latent image is formed, a developing device that develops the latent image formed on the photoreceptor with a developer, and a transfer device that transfers an image developed by the developing device to an image forming medium. The developing device includes a developing roller that carries the developer and supplies the developer to the photoreceptor and a developer layer regulating member that regulates a thickness of a layer of the developer carried on the developing roller.

DETAILED DESCRIPTION

A developer layer regulating member according to an embodiment is a member which regulates a thickness of a layer of a developer carried on a developing roller included in a developing device that develops a latent image formed on a photoreceptor and forms a transfer source image to be transferred to an image forming medium in an image forming apparatus that forms an image on the image forming medium. The developer layer regulating member includes a magnetic material extending in an axis direction of the developing roller, a non-magnetic material facing the magnetic material, a first spot weld row that bonds the magnetic material to the non-magnetic material, and a second spot weld row that bonds the magnetic material to the non-magnetic material. The magnetic material includes a first end located near the developing roller and a second end located on the opposite side of the first end. The first spot weld row extends in the axis direction of the developing roller between the first and second ends of the magnetic material. The second spot weld row extends in the axis direction of the developing roller between the first spot weld row and the second end of the magnetic material.

Figure 1:
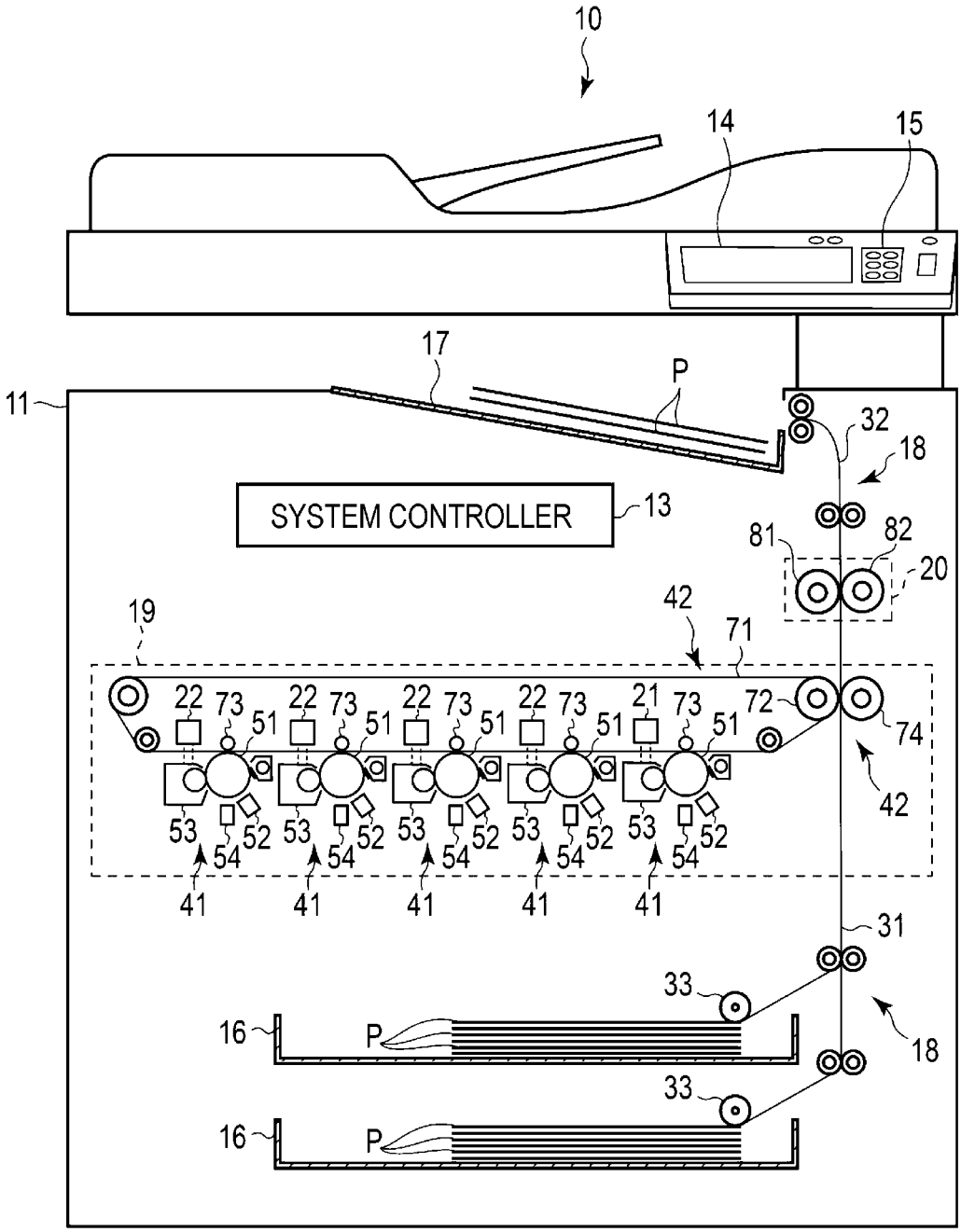
FIG. 1 is a diagram schematically illustrating a configuration of an image forming apparatus according to an embodiment.

Hereinafter, an image forming apparatus according to an embodiment will be described with reference to the drawings. FIG. 1 is a diagram schematically illustrating a configuration of an image forming apparatus 10 according to the embodiment.

The image forming apparatus 10 is, for example, a multifunction device (MFP) that performs various processes such as image forming while conveying the image forming medium.

As illustrated in FIG. 1, the image forming apparatus 10 includes a housing 11, a system controller 13, a display unit 14, an operation interface 15, a plurality of paper trays 16, a paper ejection tray 17, a conveying unit 18, and an image forming unit 19, and a fixing device 20.

The housing 11 is the main body of the image forming apparatus 10. The housing 11 contains the system controller 13, the display unit 14, the operation interface 15, the plurality of paper trays 16, the paper ejection tray 17, the conveying unit 18, the image forming unit 19, and the fixing device 20.

The system controller 13 controls the image forming apparatus 10. The system controller 13 is connected to the conveying unit 18, the image forming unit 19, the fixing device 20, and the like. The system controller 13 generates a print job for forming an image on an image forming medium P.

The print job includes image data indicating an image to be formed on the image forming medium P. The image data may be data for forming an image on one sheet of the image forming medium P, or may be data for forming an image on plural sheets of the image forming media P. The print job contains information indicating whether the print is a color print or a monochrome print.

The display unit 14 includes a display that displays a screen according to a video signal input from the system controller 13. For example, screens for various settings of the image forming apparatus 10 are displayed in the display of the display unit 14.

The operation interface 15 is connected to an operating member (not illustrated). The operation interface 15 supplies an operation signal according to the operation of the operating member to the system controller 13. The operating member is, for example, a touch sensor, a numeric keypad, a power key, a paper feed key, various function keys, a keyboard, or the like. The touch sensor acquires information indicating a designated position within a certain region. The touch sensor is configured as a touch panel integrally with the display unit 14, so that a signal indicating the touched position on the screen displayed on the display unit 14 is input to the system controller 13.

Each of the plurality of paper trays 16 is a cassette that contains the image forming medium P. The paper tray 16 is configured so that the image forming medium P can be supplied from the outside of the housing 11. For example, the paper tray 16 is configured to be retractable from the housing 11.

The paper ejection tray 17 is a tray that supports the image forming medium P ejected from the image forming apparatus 10.

The conveying unit 18 is a mechanism that conveys the image forming medium P in the image forming apparatus 10. As illustrated in FIG. 1, the conveying unit 18 includes a plurality of conveyance paths. For example, the conveying unit 18 includes a paper feed conveyance path 31 and a paper ejection conveyance path 32.

Each of the paper feed conveyance path 31 and the paper ejection conveyance path 32 is configured with a plurality of motors (not illustrated), a plurality of rollers (not illustrated), and a plurality of guides (not illustrated). The plurality of motors rotate a shaft based under the control of the system controller 13 to rotate the rollers linked with the rotation of the shaft. The plurality of rollers move the image forming medium P by rotating. The plurality of guides control the conveyance direction of the image forming medium P.

The paper feed conveyance path 31 takes in the image forming medium P from the paper tray 16 and supplies the taken-in image forming medium P to the image forming unit 19. The paper feed conveyance path 31 includes a pickup roller 33 corresponding to each paper tray 16. Each pickup roller 33 takes in the image forming medium P of the paper tray 16 into the paper feed conveyance path 31.

The paper feed conveyance path 31 and the pickup roller 33 configure an image forming medium supply device that supplies the image forming medium P.

The paper ejection conveyance path 32 is a conveyance path for ejecting the image forming medium P on which the image is formed from the housing 11. The image forming medium P ejected by the paper ejection conveyance path 32 is supported by the paper ejection tray 17.

The image forming unit 19 is configured to form an image on the image forming medium P based on the control of the system controller 13. The image forming unit 19 includes a plurality of process units 41 and a transfer device 42.

Each of the plurality of process units 41 form images of different colors by using different color developers. The developer includes toners and carriers. Toner cartridges 21 and 22 containing toners of different colors are connected to the plurality of process units 41. The toners include, for example, decolorable toners and non-decolorable toners. The decolorable toner is colored in blue. The non-decolorable toners include, for example, cyan toners, magenta toners, yellow toners and black toners.

The toner cartridges 21 and 22 include the toner cartridge 21 which is a toner cartridge containing a decolorable toner and the toner cartridge 22 which is a toner cartridge containing a non-decolorable toner. The toner cartridges 21 and 22 have the same configuration except for the toner to be contained.

Next, since the plurality of process units 41 have the same configuration except for the developer to be used, one process unit 41 will be described. With respect to the toner cartridges 21 and 22, the toner cartridge 21 containing the decolorable toner will be described.

Figure 2:
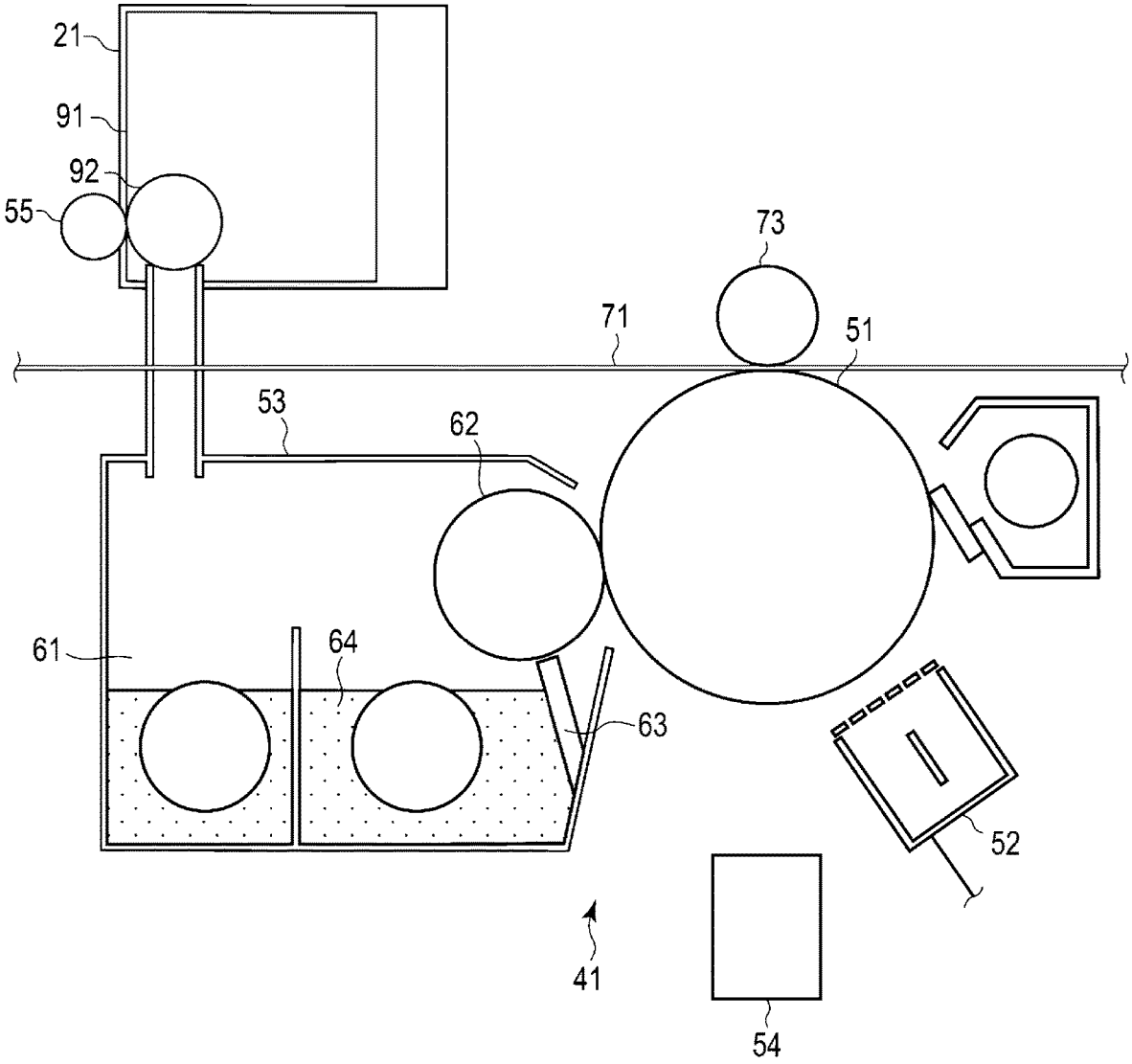
FIG. 2 is a diagram schematically illustrating a configuration of a process unit of the image forming apparatus.

FIG. 2 is a diagram schematically illustrating a configuration of the process unit 41. The process unit 41 includes a photoreceptor drum 51, an electrostatic charger 52, a developing device 53, and an exposure device 54.

The photoreceptor drum 51 includes a cylindrical drum and a photoreceptive layer formed on the outer peripheral surface of the drum. The photoreceptor drum 51 is rotated at a constant speed by a drive mechanism (not illustrated).

The electrostatic charger 52 uniformly charges the surface of the photoreceptor drum 51. For example, the electrostatic charger 52 charges the photoreceptor drum 51 to a uniform negative potential (contrast potential) by applying a voltage (development bias voltage) to the photoreceptor drum 51 by using a charging roller. The charging roller is rotated by rotating the photoreceptor drum 51 in the state where a predetermined pressure is applied to the photoreceptor drum 51.

The developing device 53 is a device that adheres the toners to the photoreceptor drum 51. The developing device 53 includes a developer container 61, a developing roller 62, and a doctor blade 63.

The developer container 61 is a container that contains a developer 64 containing the toners and the carriers. The toners are replenished from the toner cartridge 21.

The toner cartridge 21 includes a container 91 and a screw 92. The container 91 is connected to the developer container 61 of the developing device 53 when the toner cartridge 21 is mounted on the image forming apparatus 10. The screw 92 is a sending-out mechanism provided in the container 91 and rotating to send out the toner in the container 91 to the developing device 53. The screw 92 is driven by a toner replenishment motor 55 of the process unit 41.

The developing roller 62 carries the developer 64 on the surface by rotating in the developer container 61.

The doctor blade 63 is a developer layer regulating member that regulates the thickness of the layer of the developer 64 carried on the developing roller 62. The doctor blade 63 is arranged at a predetermined distance from the developing roller 62.

The exposure device 54 includes a plurality of light emitting elements. The exposure device 54 forms the latent image on the photoreceptor drum 51 by irradiating the photoreceptor drum 51 with light from the light emitting element under the control of the system controller 13. The light emitting element is a light emitting diode (LED) or the like. One light emitting element is configured to irradiate one point on the photoreceptor drum 51 with light. The plurality of light emitting elements are arranged in a main scanning direction which is a direction parallel to a rotational axis of the photoreceptor drum 51.

The exposure device 54 forms the latent image for one line on the photoreceptor drum 51 by irradiating the photoreceptor drum 51 with light by the plurality of light emitting elements arranged in the main scanning direction. The exposure device 54 forms the latent image by continuously irradiating the rotating photoreceptor drum 51 with light.

The toner replenishment motor 55 supplies the toners from the toner cartridge 21 to the developing device 53 by rotating the screw 92 of the toner cartridge 21. The toner replenishment motor 55 rotates the drive mechanism (not illustrated). The drive mechanism is connected to the screw 92 of the toner cartridge 21 when the toner cartridge 21 is mounted on the image forming apparatus 10. The screw 92 rotates in link with the rotation of the drive mechanism.

In the above-described configuration, when the surface of the photoreceptor drum 51 charged by the electrostatic charger 52 is irradiated with light from the exposure device 54, an electrostatic latent image is formed. When the layer of the developer 64 carried on the surface of the developing roller 62 approaches the photoreceptor drum 51, the toner contained in the developer 64 adheres to the latent image formed on the surface of the photoreceptor drum 51. Accordingly, the process unit 41 forms a toner image which is a transfer source image transferred to the image forming medium P on the surface of the photoreceptor drum 51.

In FIG. 1, the transfer device 42 is a device that transfers a toner image formed on the surface of the photoreceptor drum 51 to the image forming medium P. The transfer device 42 includes, for example, a primary transfer belt 71, a secondary transfer facing roller 72, a plurality of primary transfer rollers 73, and a secondary transfer roller 74.

The primary transfer belt 71 is an endless belt that is wound around the secondary transfer facing roller 72 and a plurality of winding rollers. With respect to the primary transfer belt 71, the inner surface (inner peripheral surface) is in contact with the secondary transfer facing roller 72 and a plurality of winding rollers, and the outer surface (outer peripheral surface) faces the photoreceptor drum 51 of the process unit 41.

The secondary transfer facing roller 72 is rotated by a motor (not illustrated). The secondary transfer facing roller 72 conveys the primary transfer belt 71 in a predetermined conveyance direction by rotating. The plurality of winding rollers are configured to be freely rotatable. The plurality of winding rollers rotate according to the movement of the primary transfer belt 71 by the secondary transfer facing roller 72.

The plurality of primary transfer rollers 73 have a configuration where the primary transfer belt 71 is in contact with the photoreceptor drum 51 of the process unit 41. The plurality of primary transfer rollers 73 are provided to correspond to the photoreceptor drums 51 of the plurality of process units 41. Specifically, the plurality of primary transfer rollers 73 are provided at positions facing the photoreceptor drum 51 of the corresponding process unit 41 with the primary transfer belt 71 interposed therebetween. The primary transfer roller 73 is in contact with the inner peripheral surface side of the primary transfer belt 71 and displaces the primary transfer belt 71 toward the photoreceptor drum 51. Accordingly, the primary transfer roller 73 allows the outer peripheral surface of the primary transfer belt 71 to be in contact with the photoreceptor drum 51.

The secondary transfer roller 74 is provided at a position facing the primary transfer belt 71. The secondary transfer roller 74 is in contact with the outer peripheral surface of the primary transfer belt 71 and applies pressure. Accordingly, a transfer nip is formed in which the secondary transfer roller 74 and the outer peripheral surface of the primary transfer belt 71 are in close contact with each other. When the image forming medium P passes through the transfer nip, the secondary transfer roller 74 presses the image forming medium P passing through the transfer nip against the outer peripheral surface of the primary transfer belt 71.

The secondary transfer roller 74 and the secondary transfer facing roller 72 convey the image forming medium P supplied from the paper feed conveyance path 31 in an interposed state by rotating. Accordingly, the image forming medium P passes through the transfer nip.

The toner image formed on the surface of the photoreceptor drum 51 is transferred to the outer peripheral surface of the primary transfer belt 71. When the image forming unit 19 includes the plurality of process units 41, the primary transfer belt 71 receives the toner images from the photoreceptor drums 51 of the plurality of process units 41. The toner image transferred to the outer peripheral surface of the primary transfer belt 71 is conveyed by the primary transfer belt 71 to the transfer nip in which the secondary transfer roller 74 and the outer peripheral surface of the primary transfer belt 71 are in close contact with each other. When the image forming medium P is present at the transfer nip, the toner image transferred to the outer peripheral surface of the primary transfer belt 71 is transferred to the image forming medium P at the transfer nip.

The fixing device 20 is a device that fixes the toner image on the image forming medium P on which the toner image is transferred. The fixing device 20 operates under the control of the system controller 13. The fixing device 20 includes a heating member that applies heat to the image forming medium P and a pressurizing member that applies pressure to the image forming medium P. The heating member is, for example, a heat roller 81. The pressurizing member is, for example, a press roller 82.

The heat roller 81 is a rotating body for fixing that is rotated by a motor (not illustrated). The heat roller 81 includes a core metal made of metal in a hollow shape and an elastic layer formed on the outer periphery of the core metal. The heat roller 81 is heated to a high temperature by a heater arranged inside the core metal formed in the hollow shape. The heater is, for example, a halogen heater. The heater may be an induction heating (IH) heater that heats the core metal by electromagnetic induction.

The press roller 82 is provided at a position facing the heat roller 81. The press roller 82 includes a core metal made of metal having a predetermined outer diameter, and an elastic layer formed on the outer periphery of the core metal. The press roller 82 applies pressure to the heat roller 81 by stress applied from a tension member (not illustrated). The pressure is applied from the press roller 82 to the heat roller 81, so that a nip (fixing nip) in which the press roller 82 and the heat roller 81 are in close contact with each other is formed. The press roller 82 is rotated by a motor (not illustrated). By rotating, the press roller 82 moves the image forming medium P entering the fixing nip, and the press roller 82 presses the image forming medium P against the heat roller 81.

With the above-described configuration, the heat roller 81 and the press roller 82 apply heat and pressure to the image forming medium P passing through the fixing nip. Accordingly, the toner image is fixed on the image forming medium P that passes through the fixing nip. The image forming medium P passing through the fixing nip is introduced into the paper ejection conveyance path 32 and ejected to the outside of the housing 11.

Figure 3:
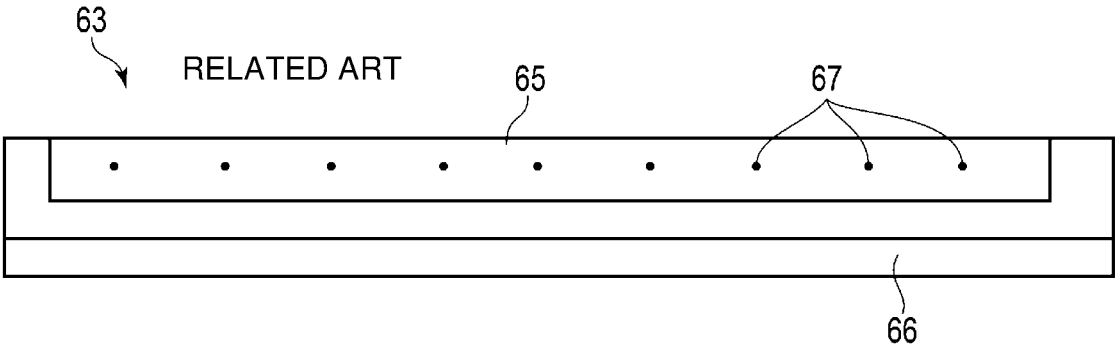
FIG. 3 is a front view of a doctor blade according to an example in the related art.
Figure 4:
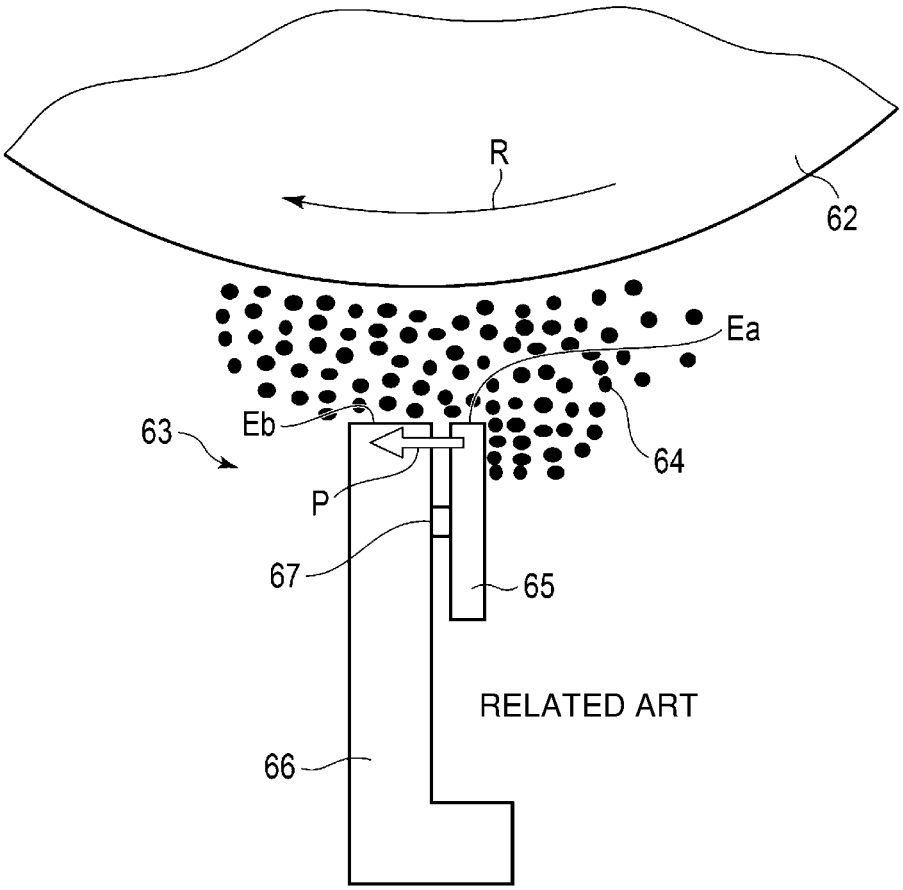
FIG. 4 is a side view schematically illustrating a doctor blade and a developing roller illustrated in FIG. 3.

Hereinafter, the doctor blade 63 will be described with reference to FIGS. 3 to 6. First, the doctor blade 63 according to an example in the related art will be described with reference to FIGS. 3 and 4. FIG. 3 is a front view of the doctor blade 63 according to the example in the related art. FIG. 4 is a side view schematically illustrating the doctor blade 63 and the developing roller 62 illustrated in FIG. 3.

As illustrated in FIG. 3, the doctor blade 63 includes a magnetic sheet metal 65 which is a magnetic material, a non-magnetic sheet metal 66 which is a non-magnetic material, and a plurality of spot welds 67 which bond the magnetic sheet metal 65 to the non-magnetic sheet metal 66.

Both the magnetic sheet metal 65 and the non-magnetic sheet metal 66 are made of metal and are elongated members. The thickness of the magnetic sheet metal 65 and the thickness of the non-magnetic sheet metal 66 are different from each other. The magnetic sheet metal 65 is a member having a plate shape. The non-magnetic sheet metal 66 is a member having an L-shaped cross section. The non-magnetic sheet metal 66 is supported by the developing device 53 (refer to FIG. 2) and supports the magnetic sheet metal 65.

The spot weld 67 is formed by spot-welding the magnetic sheet metal 65 and the non-magnetic sheet metal 66. The magnetic sheet metal 65 and the non-magnetic sheet metal 66 bonded by the spot-welding are not completely in close contact with each other, but a minute gap is formed therebetween. The plurality of spot welds 67 are formed in a row in the longitudinal axis direction of the magnetic sheet metal 65. The row of spot welds 67 is located, for example, at the center between the end faces along the direction perpendicular to the longitudinal axis of the magnetic sheet metal 65.

The magnetic sheet metal 65 and the non-magnetic sheet metal 66 are cut by using processing oil when the magnetic sheet metal 65 and the non-magnetic sheet metal 66 are processed in the manufacturing process. The processing oil is cleaned in the cleaning step in the state where both the magnetic sheet metal 65 and the non-magnetic sheet metal 66 are individual products. However, it is difficult to remove 100% of the processing oil, and in some cases, the processing oil may remain. The remaining processing oil is called residual oil.

When the processing oil used in the manufacturing process remains on the surface of the magnetic sheet metal 65 or the non-magnetic sheet metal 66, since the gap between the magnetic sheet metal 65 processed on the doctor blade 63 and the non-magnetic sheet metal 66 is narrow, air passage is bad, and thus, it is difficult to dry the residual oil. The residual oil is collected around the spot weld 67 due to the capillary phenomenon.

As illustrated in FIG. 4, the doctor blade 63 is arranged to extend in the rotational axis direction of the developing roller 62 at a predetermined distance separated from the developing roller 62. Accordingly, a distal end Ea of the magnetic sheet metal 65 and a distal end Eb of the non-magnetic sheet metal 66 extend in the axis direction of the developing roller 62 near the developing roller 62. The magnetic sheet metal 65 is located upstream of the non-magnetic sheet metal 66 in the rotational direction of the developing roller 62.

The developing roller 62 is rotated in the direction (clockwise) of arrow R. Accordingly, the lump of the developer 64 moves from the right side to the left side in FIG. 4. When the developer 64 moves, the pressure of the developer 64 is applied to the peripheral portion of the distal end of the magnetic sheet metal 65 including the distal end Ea. By the pressure of the developer 64, as indicated by the arrow P, the peripheral portion of the distal end of the magnetic sheet metal 65 is pushed toward the non-magnetic sheet metal 66 with the spot weld 67 as a fulcrum. As a result, the gap between the magnetic sheet metal 65 and the non-magnetic sheet metal 66 is narrowed.

Since the gap between the magnetic sheet metal 65 and the non-magnetic sheet metal 66 is narrowed, the residual oil collected around the spot weld 67 moves to the distal end of the doctor blade 63 due to the capillary phenomenon, and the residual oil adheres to the developer 64. The residual oil adhering to the developer 64 is stuck at the distal end of the doctor blade 63. Herein, the distal end of the doctor blade 63 is the distal end Ea of the magnetic sheet metal 65 and/or the distal end Eb of the non-magnetic sheet metal 66.

The sticking of the residual oil does not always occur uniformly in the longitudinal axis direction of the doctor blade 63. As a result, a portion where the residual oil is stuck and a portion where the residual oil is not stuck are generated in the distal end of the doctor blade 63. Therefore, the amount of the developer 64 conveyed by the developing roller 62 differs between the portion where the residual oil is stuck and the portion where the residual oil is not struck. Therefore, image defects such as white streaks is generated.

Figure 5:
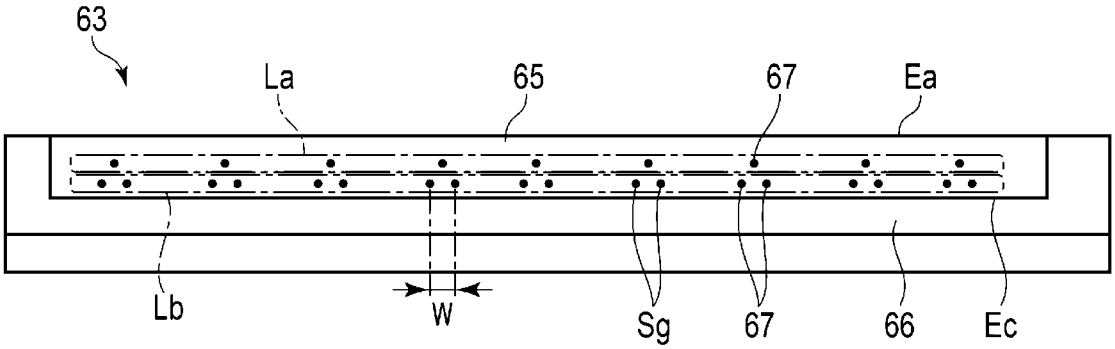
FIG. 5 is a front view of a doctor blade according to the embodiment.
Figure 6:
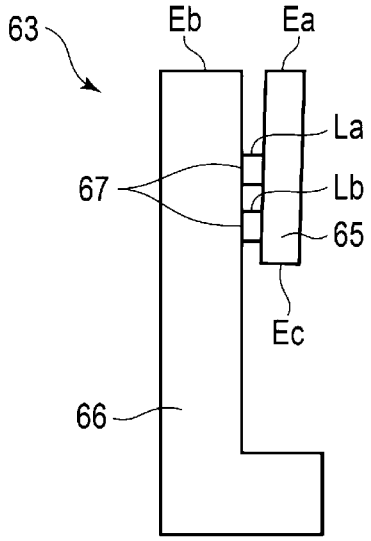
FIG. 6 is a side view of the doctor blade illustrated in FIG. 5.

Next, the doctor blade 63 according to the embodiment will be described with reference to FIGS. 5 and 6. FIG. 5 is a front view of the doctor blade 63 according to the embodiment. FIG. 6 is a side view of the doctor blade 63 illustrated in FIG. 5.

As described above, in the doctor blade 63 according to the example in the related art, as illustrated in FIG. 3, the plurality of spot welds 67 are provided in one row at the center of the magnetic sheet metal 65 in the longitudinal axis direction of the magnetic sheet metal 65.

On the other hand, in the doctor blade 63 according to the embodiment, as illustrated in FIG. 5, the plurality of spot welds 67 are provided, for example, in two rows on the magnetic sheet metal 65 in the longitudinal axis direction of the magnetic sheet metal 65. That is, the plurality of spot welds 67 have a first spot weld row La and a second spot weld row Lb.

The first spot weld row La corresponds to a plurality of spot welds 67 provided in one row of the doctor blade 63 according to the example in the related art. For example, the first spot weld row La is located at the center between the distal end Ea of the magnetic sheet metal 65 and an end Ec of the magnetic sheet metal 65 on the opposite side of the distal end Ea. The position is an example, and there is no limitation thereto. Hereinafter, for the convenience, the end Ec of the magnetic sheet metal 65 on the opposite side of the distal end Ea is called the rear end Ec of the magnetic sheet metal 65.

The second spot weld row Lb is located between the first spot weld row La and the rear end Ec of the magnetic sheet metal 65. For example, the second spot weld row Lb is located at the center between the first spot weld row La and the rear end Ec of the magnetic sheet metal 65. The position is an example, and there is no limitation thereto.

Neither the spot weld 67 of the first spot weld row La nor the spot weld 67 of the second spot weld row Lb need to be exactly aligned in a straight line. The spot welds 67 in each row may be substantially aligned in the longitudinal direction of the doctor blade 63. That is, the positions of the plurality of spot welds 67 in each row may change in the vertical direction of FIG. 5.

The number of spot welds 67 in the second spot weld row Lb is larger than the number of spot welds 67 in the first spot weld row La. For example, the number of spot welds 67 in the second spot weld row Lb is an integral multiple of the number of spot welds 67 in the first spot weld row La. In the example illustrated in FIG. 5, the number of spot welds 67 in the second spot weld row Lb is twice the number of spot welds 67 in the first spot weld row La.

The second spot weld row Lb has a plurality of spot weld groups Sg. Each spot weld group Sg corresponds to one of the spot welds 67 in the first spot weld row La. In the example illustrated in FIG. 5, each spot weld group Sg has two spot welds 67. However, without being limited thereto, each spot weld group Sg may have three or more spot welds 67.

The spot welds 67 of each spot weld group Sg are arranged symmetrically with respect to the corresponding spot welds 67 of the first spot weld row La. That is, the center of each spot weld group Sg is aligned with the corresponding spot weld 67 of the first spot weld row La in the vertical direction of FIG. 5.

Each spot weld group Sg is located near the corresponding spot weld 67 of the first spot weld row La. For example, a width W of the spot weld group Sg is smaller than the interval between two adjacent spot weld groups Sg. Herein, the width W of the spot weld group Sg is a dimension along the alignment direction of the spot weld group Sg or the spot weld 67.

In the doctor blade 63 according to the embodiment, the magnetic sheet metal 65 is bonded to the non-magnetic sheet metal 66 by forming the second spot weld row Lb in addition to the first spot weld row La. Therefore, as illustrated in FIG. 6, the gap between the rear end Ec of the magnetic sheet metal 65 and the non-magnetic sheet metal 66 is smaller than the gap between the distal end Ea of the magnetic sheet metal 65 and the non-magnetic sheet metal 66.

Therefore, due to the capillary phenomenon, the residual oil existing around the spot weld 67 is moved toward the rear end Ec of the magnetic sheet metal 65. The residual oil moved toward the rear end Ec of the magnetic sheet metal 65 spreads along the rear end Ec of the magnetic sheet metal 65.

Accordingly, when pressure is applied to the peripheral portion of the distal end of the magnetic sheet metal 65 due to the lump of the developer 64 carried on the developing roller 62, although the gap between the distal end Ea of the magnetic sheet metal 65 and the non-magnetic sheet metal 66 is narrowed, the residual oil remaining on the doctor blade 63 stays between the magnetic sheet metal 65 and the non-magnetic sheet metal 66. This is because the gap between the rear end Ec of the magnetic sheet metal 65 and the non-magnetic sheet metal 66 is maintained narrower than the gap between the distal end Ea of the magnetic sheet metal 65 and the non-magnetic sheet metal 66. As compared with the example in the related art, the presence location of residual oil also helps by being farther from the distal end of the doctor blade 63.

Accordingly, the residual oil is prevented from being stuck to the distal end of the doctor blade 63. Therefore, the amount of the developer 64 conveyed by the developing roller 62 becomes constant, and the occurrence of image defects due to the sticking of residual oil is prevented.

In the embodiment, the example in which the doctor blade 63 includes the magnetic sheet metal 65 made of metal and the non-magnetic sheet metal 66 made of non-metal is described. However, the embodiments are not limited thereto, and the doctor blade 63 may include a magnetic material and a non-magnetic material made of non-metal. For example, the doctor blade 63 may have a magnetic material and a non-magnetic material made of resin or ceramic.

In the doctor blade 63 drawn in FIG. 6, the distal end Ea of the magnetic sheet metal 65 and the distal end Eb of the non-magnetic sheet metal 66 are on the same level. That is, the distal end Ea of the magnetic sheet metal 65 and the distal end Eb of the non-magnetic sheet metal 66 are located on the same plane without a step difference. However, the embodiments are not limited thereto, and the distal end Ea of the magnetic sheet metal 65 may be located to be closer to the distal end side than the distal end Eb of the non-magnetic sheet metal 66 and located near the developing roller 62 or may be located on the rear end side and located to be far from the developing roller 62. In the configuration where the distal end Ea of the magnetic sheet metal 65 is located to be closer to the rear end side than the distal end Ea of the non-magnetic sheet metal 66, the amount of residual oil adhering to the developer 64 from the distal end of the doctor blade 63 can be expected to be reduced.

In the embodiment, the example in which the second spot weld row Lb has the plurality of spot weld group Sg is described, but the second spot weld row Lb may have an additional spot weld 67 between the spot weld groups Sg in addition to the spot weld groups Sg.

Although embodiments of the present invention have been described, the embodiments are presented as examples and are not intended to limit the scope of the invention. The embodiment can be implemented in various other forms, and various omissions, replacements, and changes can be made without departing from the spirit of the invention. Similar to being included in the scope and spirit of the invention, the embodiments and modifications thereof are included in the scope of the invention disclosed in the claims and the equivalent scope thereof.

While an embodiment has been described, the embodiment has been presented by way of example only, and is not intended to limit the scope of invention. Indeed, the novel apparatus and methods described herein may be embodied in a variety of other forms; furthermore, various omissions, substitutions, and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. A developer layer regulating member that regulates a thickness of a developer layer carried on a developing roller included in a developing device that develops a latent image, the developer layer regulating member comprising:

a magnetic material extending in an axis direction of the developing roller, the magnetic material comprising a first end located near the developing roller and a second end located on an opposite side of the first end;

a non-magnetic material facing the magnetic material;

a first spot weld row extending in the axis direction of the developing roller between the first end and the second end and bonding the magnetic material to the non-magnetic material; and a second spot weld row extending in the axis direction of the developing roller between the first spot weld row and the second end and bonding the magnetic material to the non-magnetic material, wherein a number of spot welds in the second spot weld row is larger than a number of spot welds in the first spot weld row.

2. The developer layer regulating member according to claim 1, wherein the number of spot welds in the second spot weld row is an integral multiple of the number of spot welds in the first spot weld row.

3. The developer layer regulating member according to claim 1, wherein the second spot weld row has a plurality of spot weld groups corresponding to the spot welds of the first spot weld row.

4. The developer layer regulating member according to claim 3, wherein a center of the spot weld group is aligned with the spot welds of the first spot weld row in a direction perpendicular to an alignment direction of the spot welds of the second spot weld row.

5. The developer layer regulating member according to claim 4, wherein a width of the spot weld group is smaller than an interval between the two adjacent spot weld groups.

6. The developer layer regulating member according to claim 1, wherein the first spot weld row is located at a center between the first end and the second end.

7. The developer layer regulating member according to claim 6, wherein the second spot weld row is located at a center between the first spot weld row and the second end.

8. The developer layer regulating member according to claim 1, wherein the magnetic material is located upstream of the non-magnetic material in a rotational direction of the developing roller.

9. The developer layer regulating member according to claim 8, wherein the developing device supports the non-magnetic material and the magnetic material.

10. An image forming apparatus, comprising:

a controller;

a display;

an operation interface;

at least one paper tray;

a conveying component;

an image forming component; and a developing device comprising a developer layer regulating member that regulates a thickness of a developer layer carried on a developing roller that develops a latent image formed on a photoreceptor and forms a transfer source image to be transferred to an image forming medium that forms an image on the image forming medium, the developer layer regulating member comprising:

a magnetic material extending in an axis direction of the developing roller, the magnetic material comprising a first end located near the developing roller and a second end located on an opposite side of the first end;

a non-magnetic material facing the magnetic material;

a first spot weld row extending in the axis direction of the developing roller between the first end and the second end and bonding the magnetic material to the non-magnetic material; and a second spot weld row extending in the axis direction of the developing roller between the first spot weld row and the second end and bonding the magnetic material to the non-magnetic material, wherein the first spot weld row is located at a center between the first end and the second end and the second spot weld row is located at a center between the first spot weld row and the second end.

11. The image forming apparatus according to claim 10, wherein a number of spot welds in the second spot weld row is larger than a number of spot welds in the first spot weld row.

12. The image forming apparatus according to claim 11, wherein the number of spot welds in the second spot weld row is an integral multiple of the number of spot welds in the first spot weld row.

13. The image forming apparatus according to claim 11, wherein the second spot weld row has a plurality of spot weld groups corresponding to the spot welds of the first spot weld row.

14. The image forming apparatus according to claim 13, wherein a center of the spot weld group is aligned with the spot welds of the first spot weld row in a direction perpendicular to an alignment direction of the spot welds of the second spot weld row.

15. The image forming apparatus according to claim 14, wherein a width of the spot weld group is smaller than an interval between the two adjacent spot weld groups.

16. The image forming apparatus according to claim 10, wherein the magnetic material is located upstream of the non-magnetic material in a rotational direction of the developing roller.

17. The image forming apparatus according to claim 16, wherein the developing device supports the non-magnetic material and the magnetic material.

18. A developer layer regulating member that regulates a thickness of a developer layer carried on a developing roller included in a developing device that develops a latent image, the developer layer regulating member comprising:

a magnetic material extending in an axis direction of the developing roller, the magnetic material comprising a first end located near the developing roller and a second end located on an opposite side of the first end;

a non-magnetic material facing the magnetic material;

a first spot weld row extending in the axis direction of the developing roller between the first end and the second end and bonding the magnetic material to the non-magnetic material; and a second spot weld row extending in the axis direction of the developing roller between the first spot weld row and the second end and bonding the magnetic material to the non-magnetic material, wherein the first spot weld row is located at a center between the first end and the second end and the second spot weld row is located at a center between the first spot weld row and the second end.

19. The developer layer regulating member according to claim 18, wherein the number of spot welds in the second spot weld row is an integral multiple of the number of spot welds in the first spot weld row.

20. The developer layer regulating member according to claim 18, wherein the second spot weld row has a plurality of spot weld groups corresponding to the spot welds of the first spot weld row.

* * * * *